United States Patent [19]

Jackson

[11] 4,037,782

[45] July 26, 1977

[54] ENGINE CONDITION CALCULATING DEVICE

[75] Inventor: William Nelson Jackson, St. Louis, Mo.

[73] Assignee: The United States of America as represented by the Secretary of the Army, Washington, D.C.

[21] Appl. No.: 704,712

[22] Filed: July 12, 1976

[51] Int. Cl.[2] ..... G06G 1/02; G06C 3/00

[52] U.S. Cl. ..... 235/84; 235/78 R; 235/88 M

[58] Field of Search ..... 235/84, 88, 78 N, 78 R, 235/70 A

[56] References Cited

U.S. PATENT DOCUMENTS

| | | | |
|---|---|---|---|
| 2,103,332 | 12/1937 | Mayfield | 235/84 |
| 2,834,123 | 5/1958 | Knight | 235/88 |
| 3,016,190 | 1/1962 | Baumann | 235/84 |
| 3,360,195 | 12/1967 | Fisher | 235/78 N |
| 3,795,363 | 3/1974 | Fabre | 235/88 |

*Primary Examiner*—Stephen J. Tomsky

*Attorney, Agent, or Firm*—Nathan Edelberg; Norman L. Wilson, Jr.

[57] ABSTRACT

Daily engine checks or health tests are being developed for determining the condition of an engine by relating significant performance parameters. One such health test, termed "HIT," utilizes exhaust gas temperature along with compressor speed. Since results of this test vary with outside air temperature conversions must be made by maintenance personnel and pilots. A calculating device is provided for this use.

7 Claims, 5 Drawing Figures

FIG. 1.
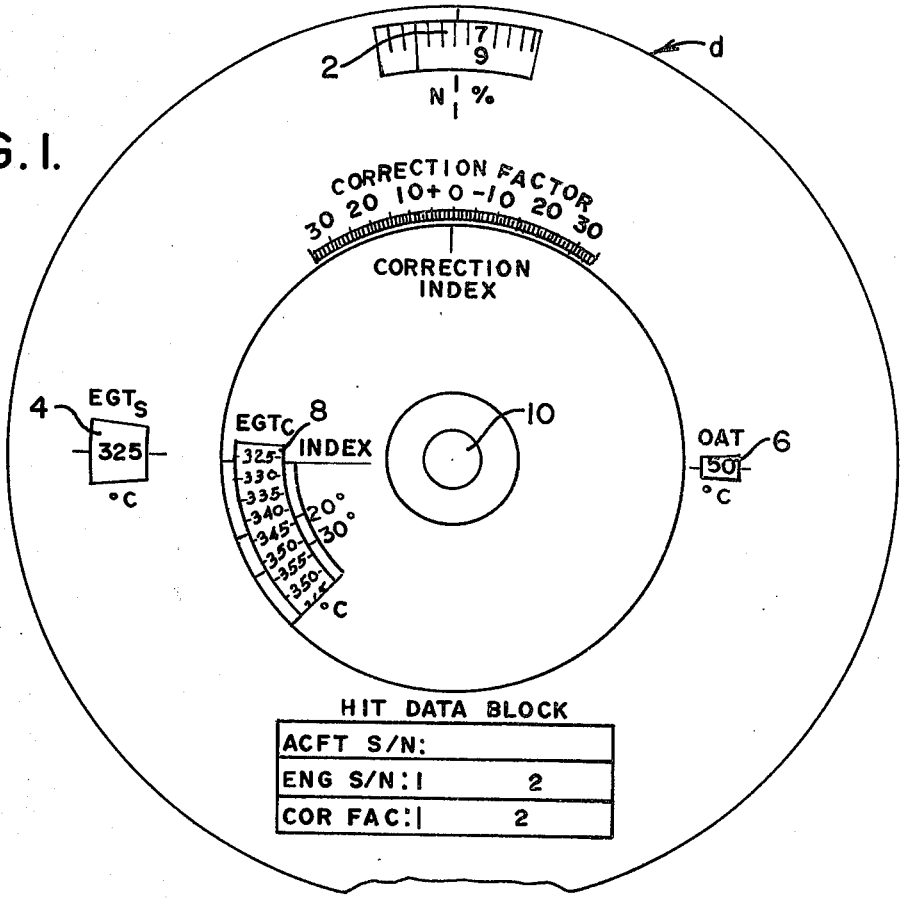
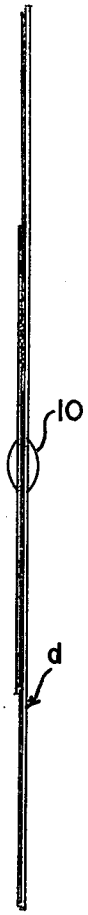
FIG. 2.
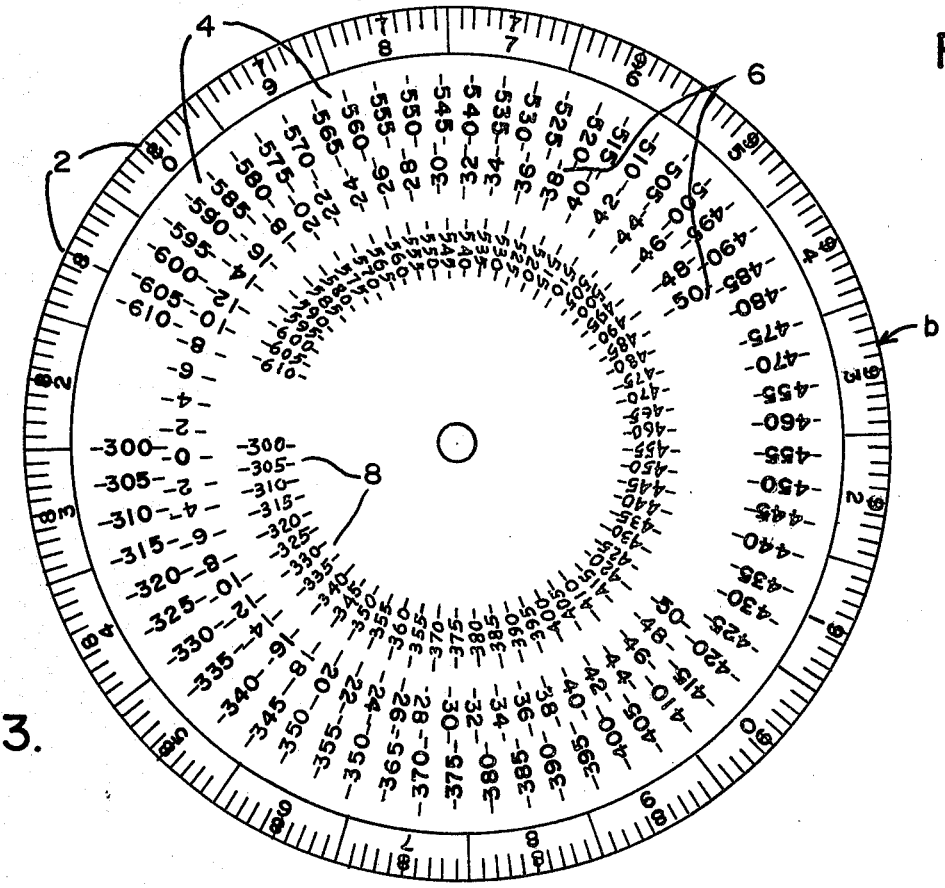
FIG. 3.

ENGINE CONDITION CALCULATING DEVICE

BACKGROUND OF THE INVENTION

This invention, broadly, pertains to turbine engine indication tests by which an aviator accomplishes day-to-day or flight-to-flight monitoring of his aircraft engine. In a specific aspect the invention relates to the so-called health indication test or HIT check for gas turbine engines. More specifically the invention relates to a calculating device which facilitates the establishment of baseline conditions involved in the HIT check.

Army aviation maintenance officers are charged with keeping their turbine engines in excellent condition. However, even though diagnostic checks, test flights and "hot end" inspections are performed on a regular basis, it is important to have a simple means by which the pilot can monitor his engine. Accordingly daily engine recording concepts or engine health tests have been developed for determining the condition of the engine by relating significant performance parameters to definite standards or baseline conditions.

One such engine health test is described in *U.S. Army Digest,* May, 1975, on pages 12–16, by F. J. McCrory, Jr. This engine check or HIT concept monitors components exposed to the engine gas path, and it utilizes the three parameters, free or outside air temperature (OAT); exhaust gas temperature (EGT), the measurement being exhaust gas temperature in degrees centigrade; and compressor speed i.e. the revolutions per minute of the gas producer section of the turbine engine ($N_1$), which is expressed in percent rpm. The speed of this section is regulated by controlling fuel to the combustor section.

As pointed out by McCrory the EGT will vary directly with OAT. Thus during cool weather an engine may seem healthy due to the lower free air temperature. In addition if the OAT is higher than the previous day's OAT a higher $\%N_1$ is necessary to give the same torque. In order to make a meaningful comparison, therefore, the parameters must be made independent of ambient temperatures. This is accomplished by converting $N_1$ and EGT parameters to standard day conditions (15° C, 29.92 inches Hg). Standard day conditions compensate for the varying air temperature conditions.

The engine manufacturer guarantees that a particular engine will produce a certain torque (power) with the $N_1$ turning at a given percent and with a given EGT. However due to slight differences in manufacturing some engines are more efficient than others. Thus each engine is unique. As a result the specific $N_1$ and EGT for any given power output (torque) will vary from engine to engine. For this reason, in addition to conversions to standard day conditions, a baseline condition for each engine must also be established.

In order to monitor engine condition and performance on a daily basis tables and EGT worksheets such as the log sheets appearing on page 14 of the McCrory reference must be prepared and placed in the engine historical record. Engine condition is based on the difference between the observed EGT and the baseline EGT. If the difference is 30° or more the aircraft is grounded.

Whereas the HIT method described by McCrory in U.S. Army Aviation Digest provides the pilot with a method of checking engine health prior to flight, it is subject to errors by maintenance officers and pilots working with the tables. As McCrory points out the monitoring method is only as good as the effort and care exercised by the maintenance officer in developing the baseline EGT and the pilot in comparing his EGT with the baseline.

This invention is directed toward overcoming the possibility of inaccuracies or errors, in the present HIT method and the need for cumbersome log sheets and their extensive set up time. Rather, I have provided a quick and accurate way to establish a trend analysis of turbine engine operating conditions.

SUMMARY OF THE INVENTION

As has been described, a method known as HIT has been provided enabling the pilot to determine the condition of this engine by relating significant performance parameters to a definite standard or baseline, to one another, and to ambient conditions. It has been found that this can best be accomplished by means of a calculating device.

The calculating device is used in monitoring turbine engine's condition, on a daily basis, from engine performance parameters $N_1$, EGT and OAT. However it eliminates the necessity of calculating a baseline. The calculating device includes a base plate having OAT, $N_1$, and first and second EGT scales increasing in predetermined directions. These values are oriented with respect to each other so that for each value of OAT corresponding values of $N_1$ and EGT are equally spaced on the base plate. A first overlay plate is adapted to overlie the base plate. This first overlay is provided with windows over the OAT, $N_1$ and one of the EGT scales oriented to expose an EGT value on the EGT scale and corresponding values of $N_1$ and OAT on the other two scales when the plate is moved from one value to another. The first overlay also has a correction factor scale of numerals imprinted thereon. A second overlay plate is adapted to overlie the first overlay plate. In the second overlay a window exposes EGT values on the second EGT scale. An indexing line is adapted to lie opposite numerals on the correction factor scale to linearly offset the window to a different EGT value on the second EGT scale based on the correction factor. This different EGT value is the baseline EGT.

DETAILED DESCRIPTION OF THE INVENTION

Basically the indicating system used herein is the exhaust gas termperature — EGT. Thus if the $N_1$ compressor speed increases, the ability of the $N_2$ power section to do its job is improved, and the EGT will increase. Similarly a decrease in compressor speed will produce a decrease in the temperature of the exhaust. In a normally functioning engine these relationships follow definite guidelines, e.g. for one engine 1% $N_1$ = 2psi torque = 15° C EGT.

In order to use these relationships it is necessary to use standard day conditions and to take into account the fact that each engine is unique. The conversion to standard day conditions and the establishment of a basis for comparison, or baseline condition, are achieved by the use of this invention.

The invention can best be understood by referring to the accompanying drawings which are for the purpose of illustration since there will be variations in calculating devices depending upon the particular aircraft model.

In the drawings,

FIG. 1 shows the calculating device of the invention.

FIG. 2 shows a cross section of the device.

Figure 4:
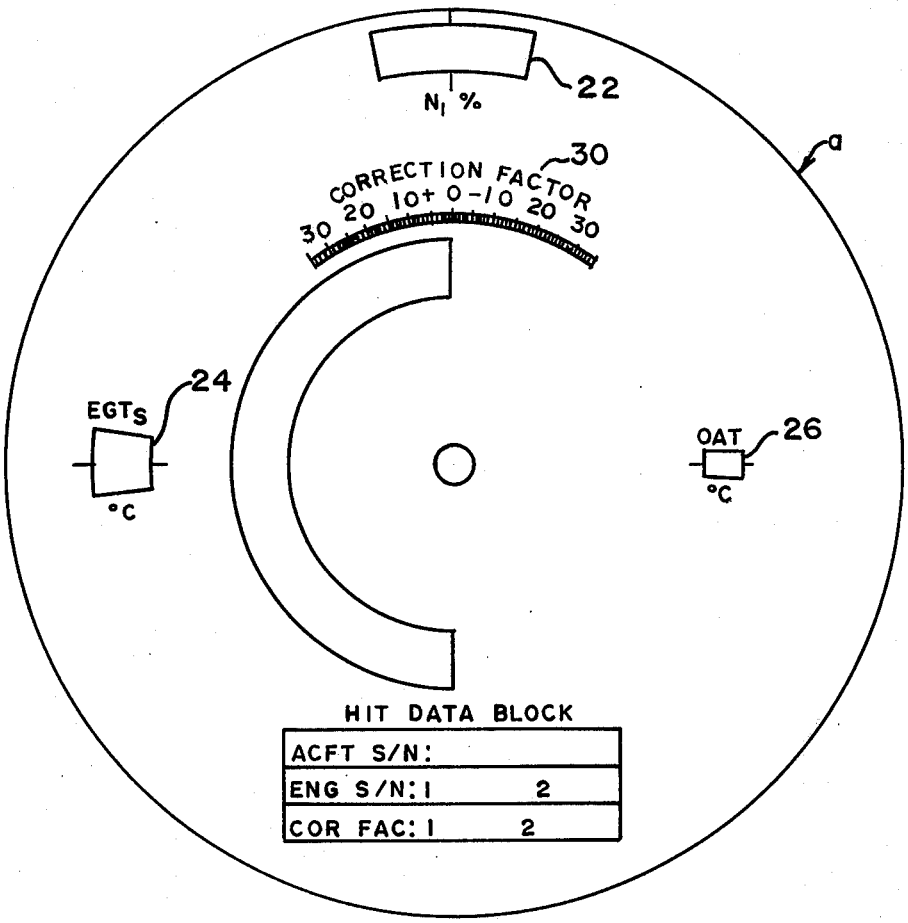
Figure 5:
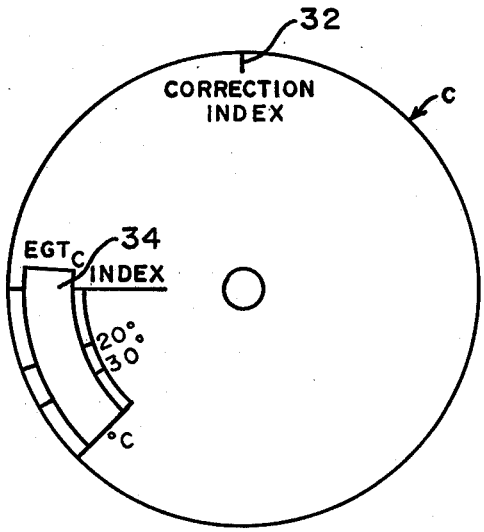

FIGS. 3, 4, and 5 are views of elements making up the calculating device.

As indicated the manufacturer will supply certain relationships for a new engine. For example in the case of the T53-L-11 at above flight idle the following relationships obtain, wherein Q is the torque:

1% $N_1$ = 2psi Q = 15° C EGT
1psi Q = 23 SHP = 200 lbs lift

From the shaft horsepower, or SHP, value, using the weight of the airframe, the characteristic values of $N_1$, EGT and OAT can be derived for the particular aircraft involved based on its gross weight. It can be seen from the development of this relationship that for each OAT there is one corresponding $N_1$ and one corresponding EGT value. These values can be derived for a range of temperatures. A good working temperature range is −50° C to +50° C, the equations of correspondence being $$\Theta = \frac{OAT \quad (\cdot\text{Absolute})}{OAT_{SD}\,(\cdot\text{Absolute})}$$
$$N_1 = N_{1SD} \times \Theta^{\frac{1}{2}}$$
$$EGT = \Theta \times EGT_{SD}$$

As a specific example, assume the characteristic values of $N_1$, EGT and OAT are 90%, 500° C and 15° C respectively, and we are to derive values of $N_1$ and EGT corresponding to an OAT of 26° C.

$$\theta = (26+273/15+273) = 1.03819$$
$$N_1 = 90X(1.03819)^{\frac{1}{2}} = 91.7$$
$$EGT = (500+273)X1.03819 - 273 = 529.5$$

The relationship of OAT to EGT is a linear one. The relationship of $N_1$ to EGT is only slightly nonlinear. Consequently in a coordinate system, one value can be spaced approximately 90 ° from one of the other values, with two values 180° apart, in a three quadrant system. This makes a circular device possible with spacings employed on base plate *b* as shown in FIG. 3.

Referring to FIG. 3 it will be seen that $N_1$ values 2 have been imprinted around the periphery of base plate *b*. These are in the range of 77 to 96.9 percent, divided in tenths. Within the $N_1$ range is imprinted the EGT range 4 of 300 to 610. The orientation of this range is such that for an $N_1$ value 2 at the top (12 o'clock, FIG. 1) there is a corresponding EGT value 4 90° to the left (9 o'clock). Similarly the orientation of the OAT scale 6, which ranges from −50° C to +50° C is such that for an $N_1$ value at 12 o'clock the corresponding OAT figure is at 3 o'clock. (FIG. 1) These scales fix our standard day conditions ($EGT_S$). However a reference or baseline must still be established. This is accomplished by the second EGT scale 8 on base plate *b* in conjunction with overlays *a* and *c* as will be described.

Referring again to FIG. 3 it will be seen that the second or inner EGT scale 8 lies toward the center within the scales discussed. The scales are in parallel so that each EGT value 8 is in alignment with EGT value 4 on the outer EGT scale, which, of course draws the numerals on inner EGT scale 8 closer together. The base plate *b* thus has an OAT scale 6, an $N_1$ scale 2 and a pair of EGT scales 4 and 8 imprinted thereon.

FIG. 4 shows the first overlay *a* which pivotally attached at the center of base plate *b* by rivet 10, or otherwise as shown in FIG. 2, to overlie the base plate *b*. In order for corresponding values of $N_1$ EGT and OAT to be exposed windows 22, 24 and 26 are provided approximately 90° apart. The windows are slightly larger than the numerals to allow for interpolation when fractional values are involved.

In addition to windows 22, 24 and 26 a numerical correction factor scale 30 is imprinted on overlay *a*. It is this correction scale which establishes the baseline. The correction factor numerical spacing bears a one to one relationship with the inner or second EGT scale, termed the "corrected" EGT scale ($EGT_c$). Thus a correction factor of +5 increases the EGT 5°. In order to facilitate this, a second overlay plate *c* is provided. This overlay is also pivotally attached to the base plate and overlies the first overlay as shown in FIG. 2. The second overlay is provided wih an indexing line 32, adapted to lie opposite the correction factor scale (correction index). It also carries a window 34 which is positioned to expose the corrected EGT value.

It has been emphasized that the characteristic values $N_1$, EGT and OAT are based on the aircraft engine torque (Q) and gross weight. Hence for each weight class of aircraft a calculating device will be required. The device shown in FIG. 1 can be used in the daily monitoring of the Cobra and Iroquois, specifically the UH-1H, the AH-1G and the TH-1G Models. A practical example will now be given illustrating this use.

When a new engine is purchased the manufacturer provides, a Model Specification, and an engine run sheet. These documents guarantee certain engine performance. Thus in the case of the AH-1G, 23 SHP = 1psi Q. From this information and a gross weight of 8600 lbs. (43 psi Q) and $N_1$ of 77.85% and an EGT of 454° C are derived. Next with the new or newly serviced aircraft the maintenance officer establishes the baseline. This is derived from the amount of lift required to produce a "light on the skids" effect, say, less than six feet off the ground. The aircraft is turned into the wind and an $N_2$ of 6600 rpm is maintained with all bleed air turned off. With the rotor turning the free air temperature is read on the cockpit gage. This number is set in the OAT window. The engine is then operated so that the $N_1$ value appearing in window 22 is obtained. The actual EGT cockpit reading is then made. The difference between this actual reading and the EGT value in window 24 is the correction factor. This factor is marked on the calculating device on the line COR FAC: in the HIT Data Block, and becomes part of the historical record until the engine is overhauled.

Now, for the flight-to-flight or day-to-day engine condition check the aviator operates the aircraft in the same manner, i.e. light on the skids, and at an $N_2$ of 6600 rpm. He reads the free air temperature and sets the OAT window accordingly. He then runs at the $N_1$ value indicated in the window and allows the EGT to stablize. His EGT gage reading should be that in window 34 with the correction factor applied. If there is a variance of 10° between consective readings, the HIT check should be performed over to substantiate the variance. If variance persists, applicable trouble shooting procedures should be instituted to determine source of variance. If the variance is 20° or greater, the aviator will notify the maintenance officer. If the variance is 30° or greater the aircraft should be grounded, until trouble shooting procedures have been accomplished to determine source of EGT change.

In a specific embodiment window 34 is provided with additional indicia giving the pilot warning or grounding temperatures by marking these 20° and 30° zones.

As indicated calculating devices will differ in $N_1$, EGT and OAT orientation for the various weight classes of aircraft. In addition the ranges of these values will be somewhat different, in the OAT range of −50° C to +50° C. Examples of these ranges are: Iroquois (UH-1B), $N_1$ 73–89, EGT 325–594; Cobra (AH-1G), $N_1$ 79–96, EGT 325–594; Kiowa (OH-58), $N_1$ 73–89, EGT 361–647; Chinook (CH-47C), $N_1$ 80–97, EGT 432–749. All of these were derived using the equations of correspondence as set forth hereinbefore. These and other variations within the skill of the art are, therefore, within the scope of this invention.

What is claimed Is:

1. A calculating device for monitoring a turbine engine's condition on a daily basis from engine performance parameters $N_1$, EGT and OAT, wherein $N_1$ measures the revolutions per minute of the gas producer section of the engine and is expressed in percent rpm, wherein EGT is engine gas temperature, and wherein OAT is outside air temperature, the calculating device comprising a base having an OAT scale increasing linearly in a predetermined direction and calibrated in degrees Celsius, an $N_1$ scale increasing linearly in the same predetermined direction and also calibrated in degrees Celsius, first and second EGT scales in parallel disposition in increasing units, the OAT, $N_1$ and EGT values being oriented with respect to each other so that for each value of OAT corresponding values of $N_1$ and EGT are equally spaced on said base plate, a first overlay plate adapted to overlie the base plate the first overlay having windows over the OAT, $N_1$ and the first EGT scales, oriented to expose an EGT value on the EGT scale and corresponding values of $N_1$ and OAT on the other two scales when the plate is moved from one value to another, and having a correction factor scale of numerals imprinted thereon, and a second overlay plate adapted to overlie the first overlay plate the second overlay having a window which exposes EGT values on the second EGT scale, and an indexing line adapted to lie opposite numerals on the correction factor scale to linearly offset the window to a different EGT value on the second EGT scale based on the correction factor.

2. A calculating device for monitoring a turbine engine's condition on a daily basis from engine performance parameters $N_1$, EGT and OAT, wherein $N_1$ measures the revolutions per minute of the gas producer section of the engine and is expressed in percent rpm, wherein EGT is engine gas temperature, and wherein OAT is outside air temperature, the calculating device comprising a base plate having OAT, $N_1$, and a pair of EGT scales imprinted thereon, the OAT scale being in the range of −50° C to +50° C, the $N_1$ scale being in the range of 73% to 96% and the EGT scles being in the range of 300° C to 749° C, the individual OAT, $N_1$, and EGT values being oriented with respect to each other so that for each value of OAT corresponding values of $N_1$ and EGT are equally spaced on said base plate, the equations of correspondence being $$\Theta = \frac{OAT \quad (\cdot\text{Absolute})}{OAT_{SD}\,(\cdot\text{Absolute})}$$
$$N_1 = N_{1SD} \times \Theta^{\frac{1}{2}}$$
$$EGT = \Theta \times EGT_{SD}$$

wherein OAT, $N_1$ and EGT are actual or indicated conditons, and $OAT_{SD}$, $N_{1SD}$ and $EGT_{SD}$ are standard day conditions, a first overlay plate pivotally attached to overlie the base plate the first overlay having windows over the OAT, $N_1$ and one of the EGT scales oriented to expose an EGT value on the EGT scale and corresponding values of $N_1$ and OAT on the other two scales when the plate is rotated from one value to another, and having a correction factor scale of numerals imprinted thereon, and a second overlay plate pivotally attached to overlie the first overlay plate the second overlay having a window which exposes EGT values on the second EGT scale, and an indexing line adapted to lie opposite numerals on the correction factor scale to linearly offset the window to a baseline EGT value on the second EGT scale based on the correction factor.

3. The calculating device of claim 2 wherein the $N_1$ range is 73 to 89 and the EGT range is 325 to 594.

4. the calculating device of claim 2 wherein the $N_1$ range is 79 to 96 and the EGT range is 325 to 594.

5. The calculating device of claim 2 wherein the $N_1$ range is 73 to 89 and the EGT range is 361 to 647.

6. The calculating device of claim 2 wherein the $N_1$ range is 80 to 97 and the EGT range is 432 to 749.

7. The calculating device of claim 2 wherein the window on the second overlay is provided with indicia at 20° and 30 ° variance points warning or grounding the aircraft.

* * * * *